US009814297B1

(12) United States Patent
Staton et al.

(10) Patent No.: US 9,814,297 B1
(45) Date of Patent: Nov. 14, 2017

(54) COSMETIC APPLICATOR

(71) Applicant: NEWTONOID TECHNOLOGIES, L.L.C., Liberty, MO (US)

(72) Inventors: Fielding B. Staton, Liberty, MO (US); David Strumpf, Columbia, MO (US)

(73) Assignee: Newtonoid Technologies, L.L.C., Liberty, MO (US)

( * ) Notice: Subject to any disclaimer, the term of this patent is extended or adjusted under 35 U.S.C. 154(b) by 0 days.

(21) Appl. No.: 15/481,254

(22) Filed: Apr. 6, 2017

(51) Int. Cl.
*A45D 34/04* (2006.01)
*A45D 44/00* (2006.01)
*A45D 40/26* (2006.01)

(52) U.S. Cl.
CPC ..... *A45D 44/005* (2013.01); *A45D 34/042* (2013.01); *A45D 40/262* (2013.01); *A45D 2044/007* (2013.01)

(58) Field of Classification Search
CPC ..... A45D 33/02; A45D 34/04; A45D 40/262; A45D 44/005; A45D 2044/007; A45D 34/042
See application file for complete search history.

(56) References Cited

U.S. PATENT DOCUMENTS 4,742,963 A 5/1988 Marvaldi
5,852,672 A 12/1998 Lu
6,218,639 B1 4/2001 Bulle
7,124,066 B2 10/2006 Marschner et al.
8,328,172 B2 12/2012 Hall et al.
8,694,160 B2 4/2014 Yasue et al.
8,757,516 B2 6/2014 Spiegel et al.
9,061,295 B2 6/2015 Fedorov
2004/0078278 A1* 4/2004 Dauga ..... A45D 44/005 434/100
2009/0114236 A1* 5/2009 Mehta ..... A45D 44/00 132/200
2010/0142755 A1* 6/2010 Brandewie ..... G06Q 30/02 382/100
2011/0129283 A1* 6/2011 Samain ..... A45D 44/005 401/5
2011/0162673 A1* 7/2011 Samain ..... A45D 44/005 132/317
2011/0164263 A1* 7/2011 Samain ..... A45D 44/005 358/1.9

(Continued)

*Primary Examiner* — Darren W Gorman
(74) *Attorney, Agent, or Firm* — Lathrop Gage LLP

(57) ABSTRACT

A makeup applicator is provided for automatically applying makeup to a face located in an application zone, and includes computer memory; a scanning device positioned to obtain facial-structure, facial-position, and facial-tone information from the zone; a carriage; carriage actuators for moving the carriage laterally and transversely adjacent the zone; a cosmetic airbrush unit coupled to and movable with the carriage; and a processor in data communication with the memory, the scanning device, and the carriage actuators. The cosmetic airbrush unit has an output nozzle, a supply passage for supplying makeup from a cosmetic reservoir to the output nozzle, and a valve selectively allowing the makeup to flow through the supply passage and the output nozzle. Programming causes the carriage actuators to move the carriage, and the airbrush unit valve to allow the makeup to flow through the supply passage and the output nozzle, applying the makeup to the human face.

7 Claims, 14 Drawing Sheets

(56) References Cited

U.S. PATENT DOCUMENTS

| | | | | |
|---|---|---|---|---|
| 2012/0029417 | A1* | 2/2012 | Samain | A61K 8/49 604/20 |
| 2012/0067364 | A1* | 3/2012 | Wong | A45D 44/005 132/200 |
| 2012/0158184 | A1* | 6/2012 | Ma | B25J 9/1679 700/264 |
| 2013/0216295 | A1* | 8/2013 | Wong | A45D 44/005 401/195 |
| 2013/0302078 | A1* | 11/2013 | Edgar | A45D 44/005 401/5 |
| 2014/0161507 | A1* | 6/2014 | Wong | A45D 40/00 401/195 |
| 2014/0174463 | A1* | 6/2014 | Wong | A45D 34/042 132/200 |
| 2015/0189972 | A1* | 7/2015 | Mehta | A45D 34/04 132/200 |
| 2015/0356661 | A1* | 12/2015 | Rousay | G06Q 30/0631 705/26.7 |
| 2015/0359714 | A1* | 12/2015 | Rabe | G06T 7/0012 132/317 |
| 2016/0143422 | A1* | 5/2016 | Yamanashi | G06T 11/001 345/634 |
| 2016/0360854 | A1* | 12/2016 | Rabe | A61B 5/0075 |
| 2017/0069052 | A1* | 3/2017 | Li | G06T 1/0014 |
| 2017/0193283 | A1* | 7/2017 | Li | G06K 9/00268 |

* cited by examiner

COSMETIC APPLICATOR

BACKGROUND

Products containing color pigments that are intended to alter a wearer's appearance when applied to the skin are commonly referred to as makeup. Makeup that is meant to be used on the face is traditionally applied with a brush, a sponge, or fingertips. Properly applying makeup to the skin can be a lengthy process that requires training and experience, and many people feel that they are unable to properly apply makeup to themselves. Accordingly, various schools offer programs in cosmetology or makeup artistry. Yet some people may not want to visit a cosmetologist on a regular (e.g., daily) basis, due for example to cost and time constraints. And cosmetologists may not always be readily available.

Embodiments of the current invention relate generally to makeup applicators and methods of applying makeup.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

According to one embodiment, a system is provided for automatically applying makeup to a human face located in an application zone. The makeup applicator includes a non-transitory computer memory; a scanning device positioned to obtain facial-structure information, facial-position information, and facial-tone information from the application zone; a carriage; carriage actuators for moving the carriage laterally and transversely adjacent the application zone; a cosmetic airbrush unit coupled to and movable with the carriage; and a processor in data communication with the computer memory, the scanning device, and the carriage actuators. The cosmetic airbrush unit has an output nozzle, a supply passage for supplying makeup from a cosmetic reservoir to the output nozzle, and a valve selectively allowing the makeup to flow through the supply passage and the output nozzle. The valve is in data communication with the processor. Programming causes: (a) the scanning device to obtain the facial-structure information, the facial-position information, and the facial-tone information; (b) the computer memory to store the obtained facial-structure information, the obtained facial-position information, and the obtained facial-tone information; (c) the carriage actuators to selectively move the carriage; and (d) the airbrush unit valve to selectively allow the makeup to flow through the supply passage and the output nozzle, whereby applying the makeup to the human face.

According to another embodiment, a system is provided for automatically applying makeup to a human face located in an application zone. The makeup applicator includes a non-transitory computer memory; a scanning device positioned to obtain facial-structure information and facial-position information from the application zone; a carriage; carriage actuators for moving the carriage laterally and transversely adjacent the application zone; a cosmetic airbrush unit coupled to and movable with the carriage; and a processor in data communication with the computer memory, the scanning device, and the carriage actuators.

The cosmetic airbrush unit has an output nozzle, a supply passage for supplying makeup from a cosmetic reservoir to the output nozzle, and a valve selectively allowing the makeup to flow through the supply passage and the output nozzle. The valve is in data communication with the processor. Programming causes: (a) the scanning device to obtain the facial-structure information and the facial-position information; (b) the computer memory to store the obtained facial-structure information and the obtained facial-position information; (c) the carriage actuators to selectively move the carriage; and (d) the airbrush unit valve to selectively allow the makeup to flow through the supply passage and the output nozzle, whereby applying the makeup to the human face.

According to still another embodiment, a system is provided for automatically applying makeup to a human face located in an application zone. The makeup applicator includes a non-transitory computer memory; a scanning device positioned to obtain facial-structure information, facial-position information, and facial-tone information from the application zone; a carriage; carriage actuators for moving the carriage laterally and transversely adjacent the application zone; a cosmetic airbrush unit coupled to and movable with the carriage; and a processor in data communication with the computer memory, the scanning device, and the carriage actuators. The cosmetic airbrush unit has first and second output nozzles, a first supply passage for supplying first makeup from a first cosmetic reservoir to the first output nozzle, a first valve selectively allowing the first makeup to flow through the first supply passage and the first output nozzle, a second supply passage for supplying second makeup from a second cosmetic reservoir to the second output nozzle, and a second valve selectively allowing the second makeup to flow through the second supply passage and the second output nozzle. The first valve is in data communication with the processor, and the second valve is in data communication with the processor. Programming causes: (a) the scanning device to obtain the facial-structure information, the facial-position information, and the facial-tone information; (b) the computer memory to store the obtained facial-structure information, the obtained facial-position information, and the obtained facial-tone information; (c) the carriage actuators to selectively move the carriage; (d) the first valve to selectively allow the first makeup to flow through the first supply passage and the first output nozzle, whereby applying the first makeup to the human face; and (e) the second valve to selectively allow the second makeup to flow through the second supply passage and the second output nozzle, whereby applying the second makeup to the human face.

According to yet another embodiment, a system is provided for automatically applying makeup to a human face located in an application zone. The makeup applicator includes a first cosmetic reservoir housing first makeup; a second cosmetic reservoir housing second makeup; a mixing reservoir in communication with the first and second reservoirs; a non-transitory computer memory; a scanning device positioned to obtain facial-structure information, facial-position information, and facial-tone information from the application zone; a carriage; carriage actuators for moving the carriage laterally and transversely adjacent the application zone; a cosmetic airbrush unit coupled to and movable with the carriage; and a processor in data communication with the computer memory, the scanning device, the carriage actuators. The mixing reservoir selectively receives the first makeup and the second makeup from the first and second reservoirs, whereby creating a third makeup. The cosmetic airbrush unit has a first output nozzle, a first supply passage for supplying the first makeup from the first reservoir to the first output nozzle, a first valve selectively allowing the first makeup to flow through the first supply passage and the first output nozzle, a second output nozzle, a second supply passage for supplying the second makeup from the second reservoir to the second output nozzle, a second valve selectively allowing the second makeup to flow through the second supply passage and the second output nozzle, a third output nozzle, a third supply passage for supplying the third makeup from the mixing reservoir to the third output nozzle, and a third valve selectively allowing the third makeup to flow through the third supply passage and the third output nozzle. The first valve is in data communication with the processor, the second valve is in data communication with the processor, and the third valve is in data communication with the processor. Programming causes: (a) the scanning device to obtain the facial-structure information, the facial-position information, and the facial-tone information; (b) the computer memory to store the obtained facial-structure information, the obtained facial-position information, and the obtained facial-tone information; (c) the carriage actuators to selectively move the carriage; (d) the first valve to selectively allow the first makeup to flow through the first supply passage and the first output nozzle, whereby applying the first makeup to the human face; (e) the second valve to selectively allow the second makeup to flow through the second supply passage and the second output nozzle, whereby applying the second makeup to the human face; and (f) programming causing the third valve to selectively allow the third makeup to flow through the third supply passage and the third output nozzle, whereby applying the third makeup to the human face.

According to still yet another embodiment, a system is provided for automatically applying a cosmetic product to a human face located in an application zone. The cosmetic applicator includes a non-transitory computer memory; a scanning device positioned to obtain facial-structure information, facial-position information, and facial-tone information from the application zone; a carriage; carriage actuators for moving the carriage laterally and transversely adjacent the application zone; a cosmetic unit coupled to and movable with the carriage to apply the cosmetic product to the face; and a processor in data communication with the computer memory, the scanning device, and the carriage actuators. Programming causes: (a) the scanning device to obtain the facial-structure information, the facial-position information, and the facial-tone information; (b) the computer memory to store the obtained facial-structure information, the obtained facial-position information, and the obtained facial-tone information; and (c) the carriage actuators to selectively move the carriage.

DETAILED DESCRIPTION

Figure 1:
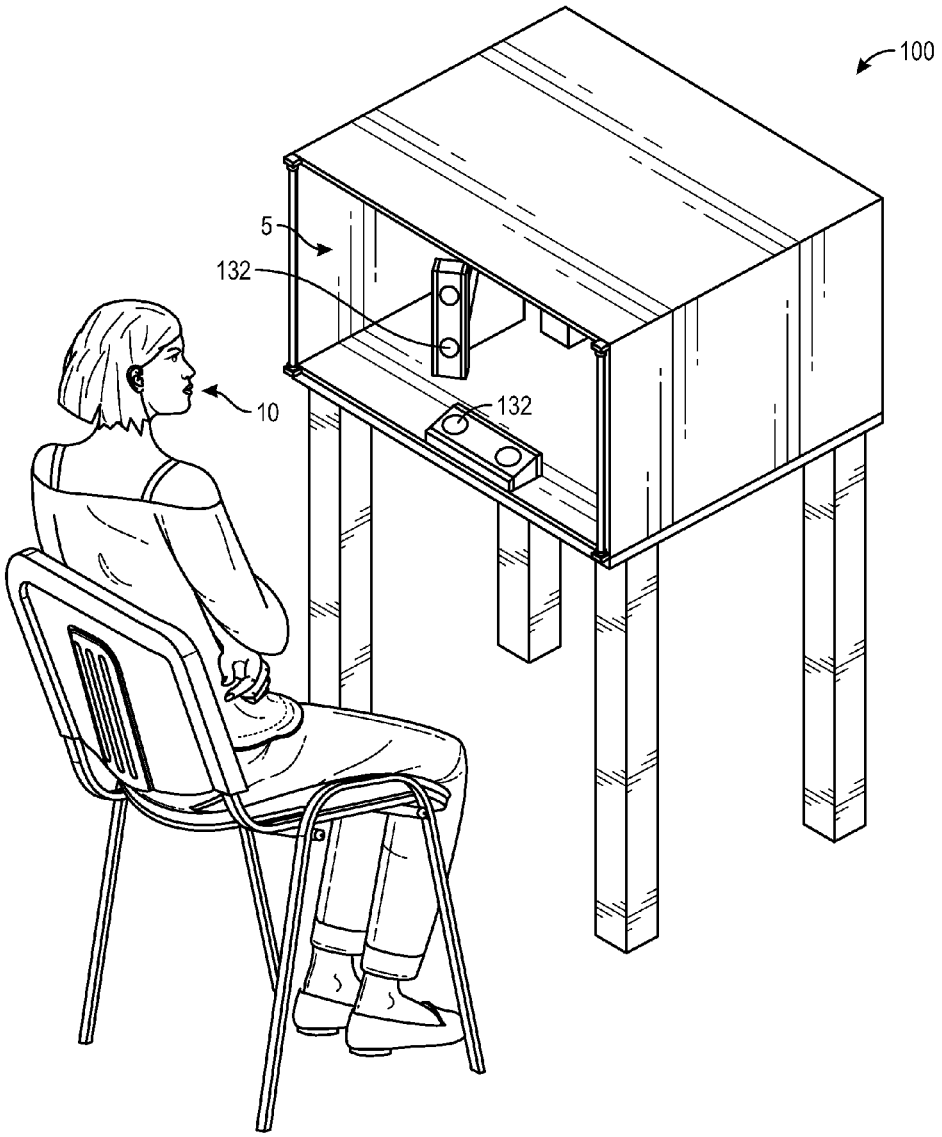
FIG. 1 is a perspective view of a makeup applicator according to an embodiment of the current invention, shown with a user.

FIGS. 1 through 8 illustrate a cosmetic applicator, and more specifically a system for automatically applying cosmetic (e.g., makeup or moisturizer) 20 to a human face 10 located in an application zone 5, according to an embodiment 100 of the current invention. The makeup applicator 100 includes non-transitory computer memory 110, a processor 120, a scanning device 130, an input 140, a carriage 150, carriage actuators 160, a cosmetic unit 170, and various programming as discussed below.

The computer memory 110 (FIG. 3) may include volatile and non-volatile memory, and any appropriate data storage devices whether now existing or later developed may be used. Further, the computer memory 110 may be a unitary memory in one location, or may alternately be a distributed computer memory such that one portion of the computer memory is physically separate from another portion of the non-transitory computer memory. In other words, discrete computer memory devices may be linked together (e.g., over a network) and collectively form the computer memory 110. While this document shall often refer to elements in the singular, those skilled in the art will appreciate that multiple such elements may often be employed and that the use of multiple such elements which collectively perform as expressly or inherently disclosed is fully contemplated herein.

The processor 120 (FIG. 3) may be any appropriate device, whether now existing or later developed, which performs the operations specified by the various programming used by the makeup applicator 100. The processor 120 may be electronic circuitry located on a common chip or circuit board, or may be a distributed processor such that one portion of the processor is physically separate from another portion of the processor. The processor 120 is in data communication with the computer memory 110, the scanner 130, the input 140, the output 145, the carriage actuators 160, and the cosmetic unit 170.

The scanner 130 uses three-dimensional sensors 132 to capture information about the face 10, including facial-structure information 1010 (which may include, for example, information regarding face shape and contour of the eyes, nose, cheeks, jaw, chin, and skin) and facial-position information 1050 (information regarding where the face 10 is located, preferably in real time). Facial scanning and mapping is disclosed, for example, in U.S. Pat. No.

Figure 2:
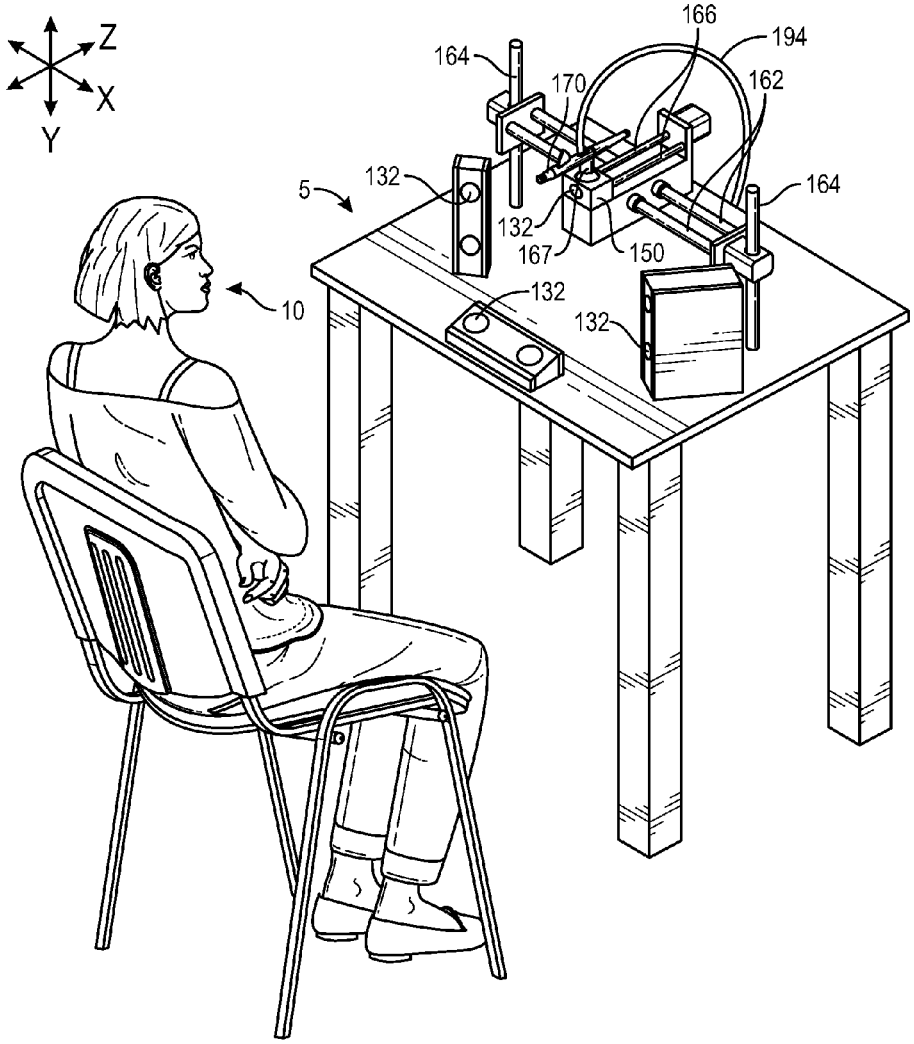
FIG. 2 is another perspective view of the makeup applicator of FIG. 1, shown with a user but with various structure removed for illustration.
Figure 3:
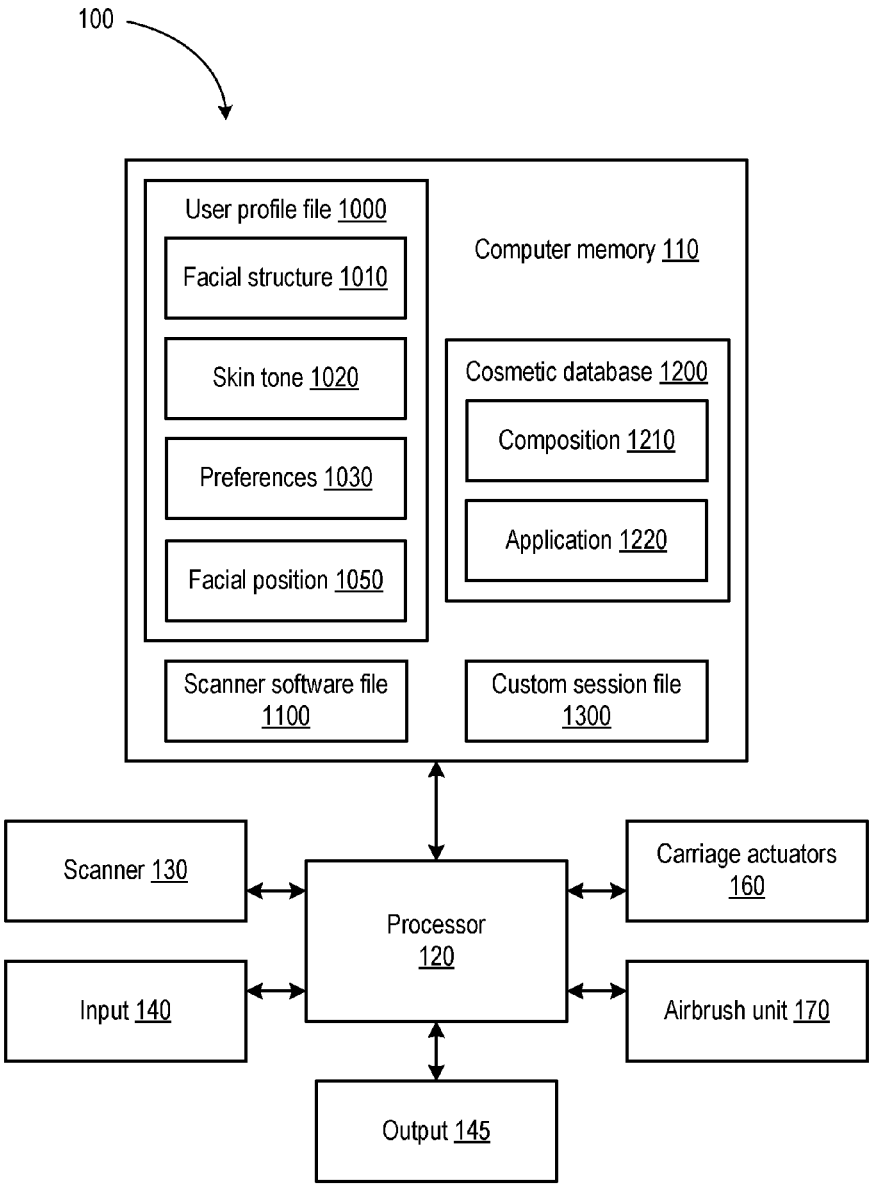
FIG. 3 is a block diagram illustrating aspects of the makeup applicator of FIG. 1.

7,124,066 to Marschner and U.S. Pat. No. 5,852,672 to Lu; the contents of each are incorporated herein in their entirety by reference. The scanner 130 further includes the ability to detect facial-tone information 1020, either through the sensors 132 or different sensors. Facial-tone information 1020 may include, for example, information about the tint of the face 10 at various locations of the skin. FIGS. 1 and 2 show that multiple sensors 132 may be positioned about the application zone 5, including on the carriage 150.

The input 140 (FIG. 3) may be any input device (whether now existing or later developed) allowing a person to input personal preference information 1030 for storage in the computer memory 110. For example, the input 140 may be a touchscreen, a keyboard, a computer mouse, a microphone, or a barcode reader. Personal preference information 1030 is discussed in additional detail below.

The output 145 (FIG. 3) may be any appropriate output device (whether now existing or later developed). For example, the output 145 may be one or more of a visual display, an audible output, and a scent dispersing device. The output 145 may be used to entertain the user, to provide ambiance, and to provide interaction with the processor 120. For example, the output 145 may provide visual/audible programming (either preset or selectable), one or more scents, and instructions (e.g., instructions to close eyes, reposition the user, et cetera).

The carriage 150 (FIG. 2) supports the cosmetic unit 170 and is selectively moved in three dimensions adjacent the application zone 5 by the carriage actuators 160. In essence, the carriage 150 and the carriage actuators 160, together with software and processing, equate to a computer numerical control ("CNC") system. One prior art CNC system is disclosed in U.S. Pat. No. 6,218,639 to Bulle, the contents of which are incorporated herein in their entirety by reference. Like in Bulle, the actuators 160 allow movement in x, y, and z directions.

Figure 4:
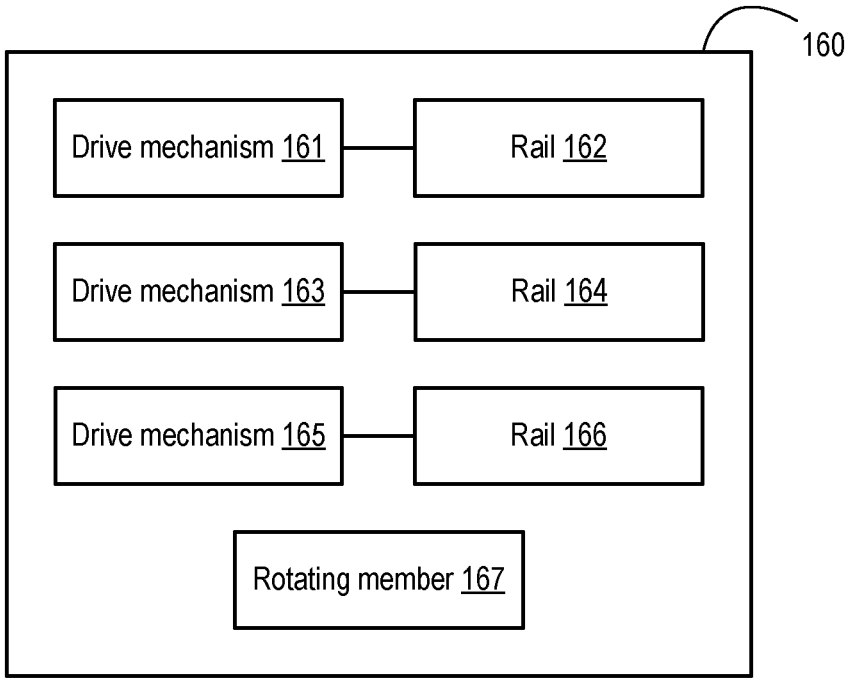
FIG. 4 is a block diagram illustrating other aspects of the makeup applicator of FIG. 1.
Figure 13:
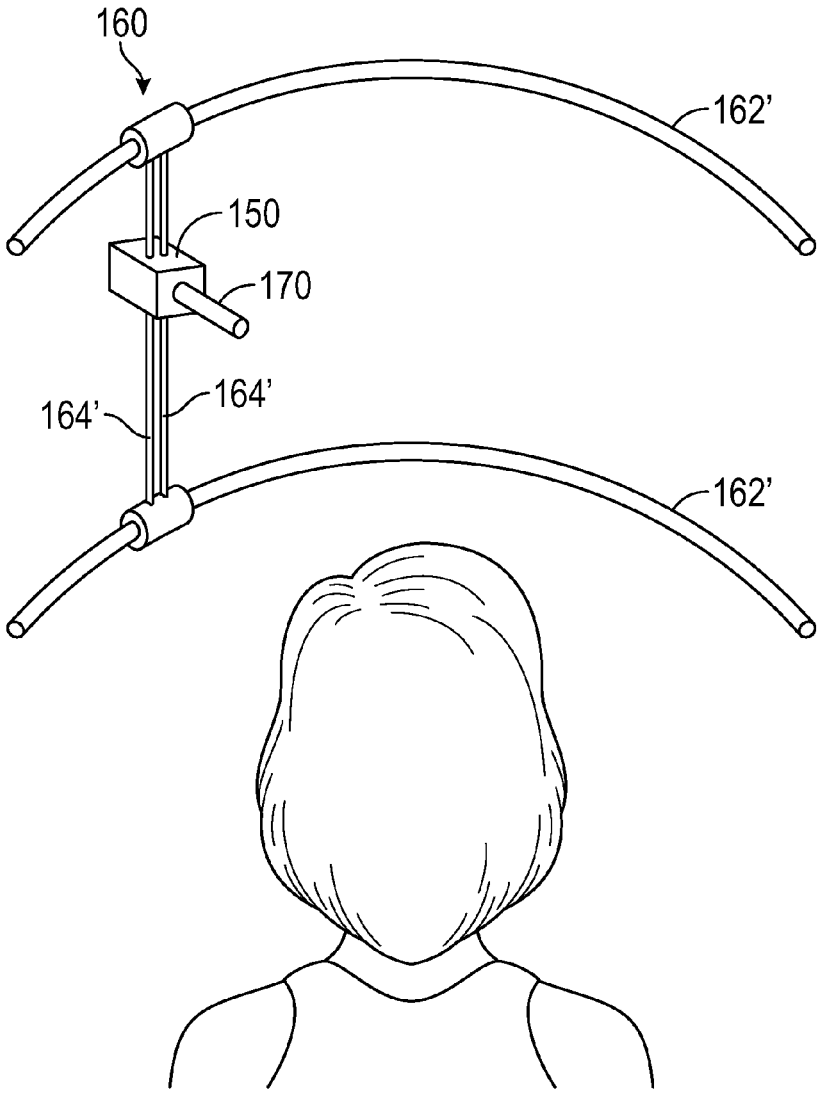
FIG. 13 illustrates alternate carriage actuators according to an embodiment of the current invention.

As shown in FIGS. 2 and 4, the carriage actuators 160 may include a drive mechanism 161 and rail 162 system which allows lateral travel, a drive mechanism 163 and rail 164 system which allows transverse (in the depicted orientation, vertical) travel, and a drive mechanism 165 and rail 166 system which allows further transverse (in the depicted orientation, front/back) travel. Drive mechanisms providing travel along rails in CNC systems are disclosed, for example, in Bulle. The carriage actuators 160 may further include a rotating member 167, which may rotate about a single axis or in multiple dimensions (such as through a ball-and-socket joint). In other embodiments, the carriage actuators 160 may include a set of curved rails 162' (FIG. 13) which allow lateral and front/back travel and another set of rails 164' which allow vertical travel. In such embodiments, the cosmetic unit 170 may be properly angled as the carriage 150 travels along the curved rails 162', and a rotating member such as 167 may be unnecessary or may rotate a more limited amount. An in still other embodiments, the carriage actuators 160 may include a robotic arm movable in at least lateral and transverse directions adjacent the application zone 5. One such robotic arm which may be utilized in the current invention is disclosed in U.S. Pat. No. 8,694,160 to Yasue, the contents of which are incorporated herein in their entirety by reference.

Figure 5:
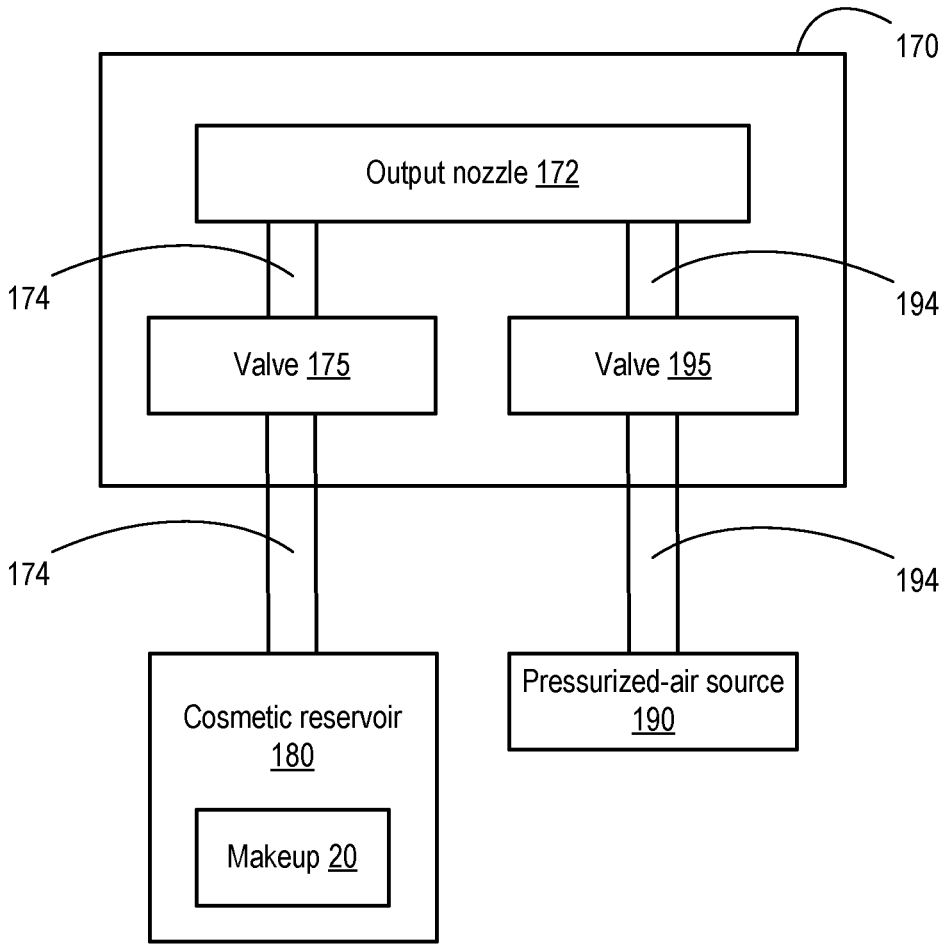
FIG. 5 is a block diagram illustrating still other aspects of the makeup applicator of FIG. 1.
Figure 6:
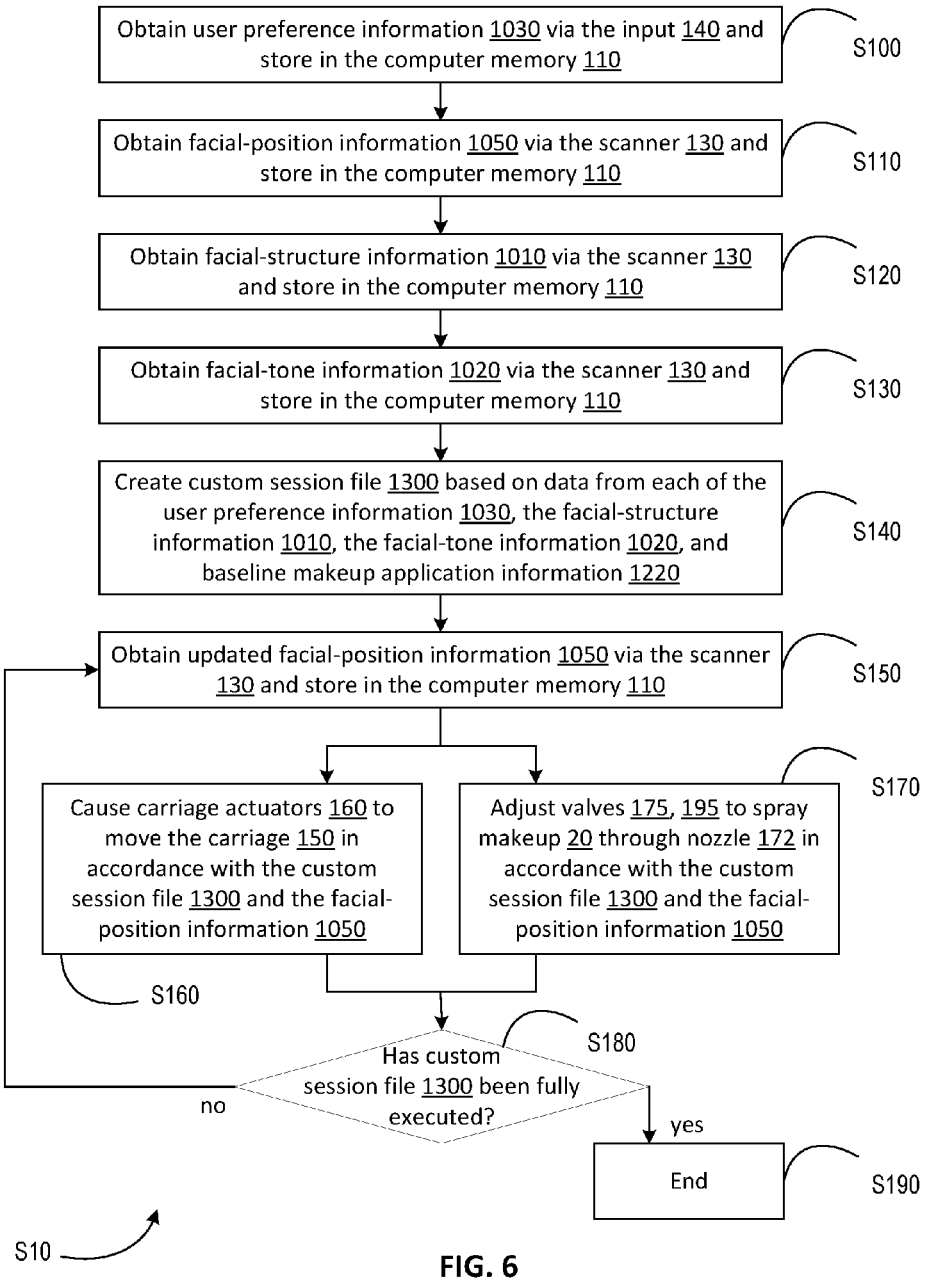
FIG. 6 is a flowchart illustrating various steps performed by the makeup applicator of FIG. 1.

The cosmetic unit 170 is coupled to and movable with the carriage 150, as shown in FIG. 2. As shown in FIG. 5, the cosmetic unit 170 may include a cosmetic airbrush 171 having an output nozzle 172, a supply passage 174 for supplying the makeup 20 from a cosmetic reservoir 180 to the output nozzle 172, and a valve 175 selectively allowing the makeup 20 to flow through the supply passage 174 and the output nozzle 172. The valve 175 is in data communication with the processor 120. In some embodiments, the cosmetic reservoir 180 is separate from the carriage 150 and the supply passage 174 includes tubing extending to the cosmetic reservoir 180. In other embodiments, the cosmetic reservoir 180 is supported by the carriage 150 and may even be formed as part of the cosmetic unit 170. Example cosmetic airbrushes 171 are disclosed in U.S. Pat. No. 9,061,295 to Fedorov, U.S. Pat. No. 8,757,516 to Spiegel, and U.S. Pat. No. 4,742,963 to Marvaldi; the contents of each are incorporated herein by reference in their entirety.

A pressurized-air source 190, such as an air tank housing compressed air or a compressor for compressing air, is in communication with the cosmetic airbrush 171 (e.g., through tubing 194), as shown in FIG. 5. And another valve 195 in data communication with the processor 120 controls passage of the pressurized air. The makeup 20 is dispensed from the output nozzle 172 when both the pressurized air and the makeup 20 are supplied through the valves 175, 195. Fedorov further discusses the flow of makeup and pressurized air.

Returning now to FIG. 3, the computer memory 110 has various files and subfiles for containing programming and data. A user profile file 1000, a scanner software file 1100, a cosmetic database 1200, and a custom session file 1300 are illustrated. The cosmetic database 1200 includes makeup composition information 1210 (e.g., makeup identification information, makeup color information, et cetera) and baseline makeup application information 1220 (e.g., baseline routines for applying makeup to different face shapes; to different contours of the eyes, nose, cheeks, jaw, chin, and skin; to different skin tones; to obtain different makeup styles; et cetera). Programming, for example in the scanner software file 1100, causes the scanning device 130 to obtain the facial-structure information 1010 and the facial-tone information 1020, and to repeatedly obtain the facial-position information 1050 (preferably in real time), and causes the obtained information 1010, 1020, 1050 to be stored (e.g., in the user profile file 1000). Other programming (e.g., in the user profile file 1000) allows personal preferences 1030 to be obtained through the input 140 and stored. The personal preferences 1030 may include, for example, desired makeup style information, desired color palette information, available makeup, et cetera. And still other programming causes the processor 120 to create the custom session file 1300 based on data from the facial-structure information 1010, the facial-tone information 1020, the user preference file 1030, and the baseline makeup application information 1220. And using the custom session file 1300 and the then-current facial position information 1050, the processor 120 causes the carriage actuators 160 to selectively move the carriage in a defined manner and causes the valves 175, 195 to selectively allow the makeup 20 to flow through the supply passage 174 and the output nozzle 172 to apply the makeup 20 to the face 10.

The following description is an example of the makeup applicator 100 in use according to an embodiment. At step S100 at method S10, the processor 120 obtains user preference information 1030 via the input 140 and stores the user preference information 1030 in the computer memory 110. And at steps S110, S120, and S130, the processor 120 obtains facial-position information 150, facial structure information 1010, and facial-tone information 1020 via the scanner 130 and stores the facial-position information 150, the facial structure information 1010, and the facial-tone information 1020 in the memory 110. At step S140, the processor 120 creates custom session file 1300 based on data from the facial-structure information 1010, the facial-tone information 1020, the user preference file 1030, and the baseline makeup application information 1220. Step S140 is explained in additional detail below with reference to FIG. 7.

After step S140, the processor 120 at step S150 obtains updated facial-position information 1050 via the scanner 130 and stores the updated facial-position information 1050 in the computer memory 110. And at steps S160 and S170, the processor 120 causes the carriage actuators 160 to move the carriage 150 in accordance with the custom session file 1300 and the facial-position information 1050, and causes the valves 175, 195 to selectively allow the makeup 20 to flow through the supply passage 174 and the output nozzle 172 to apply the makeup 20 to the face 10. After steps S160 and S170, the processor 120 determines at S180 if the custom session file 1300 has been fully executed for the particular makeup 20. If not, the process returns to step S150; if so, the process S10 ends at step S190.

Figure 7:
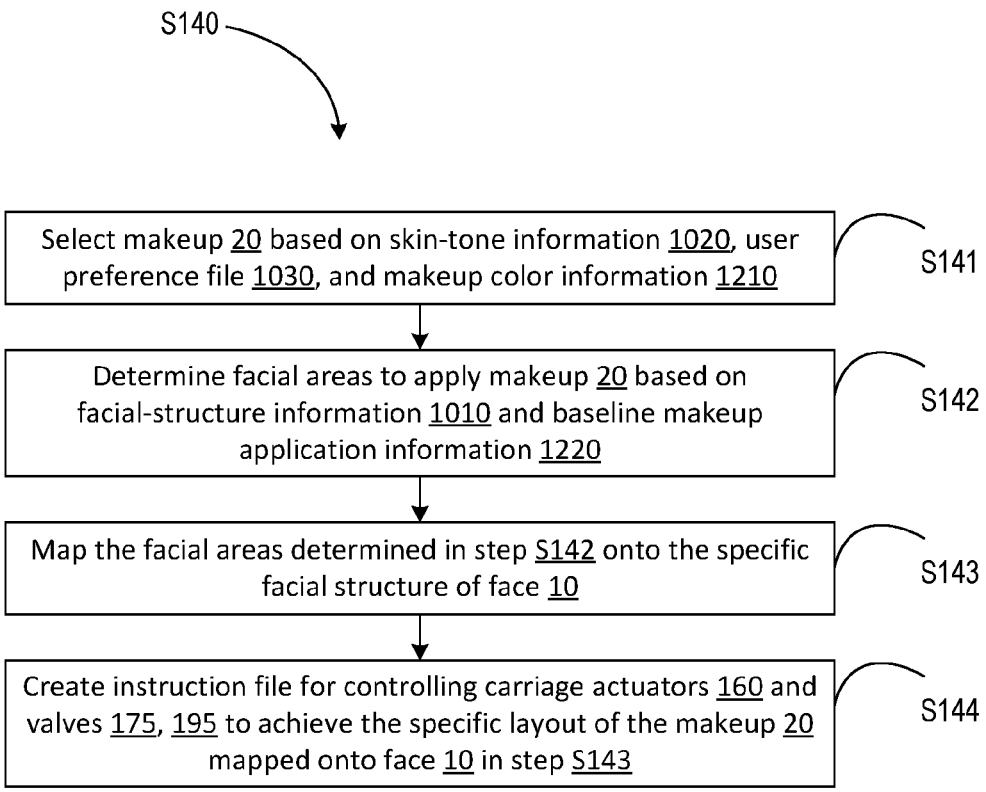
FIG. 7 is a flowchart further illustrating various steps performed by the makeup applicator of FIG. 1.
Figure 8:
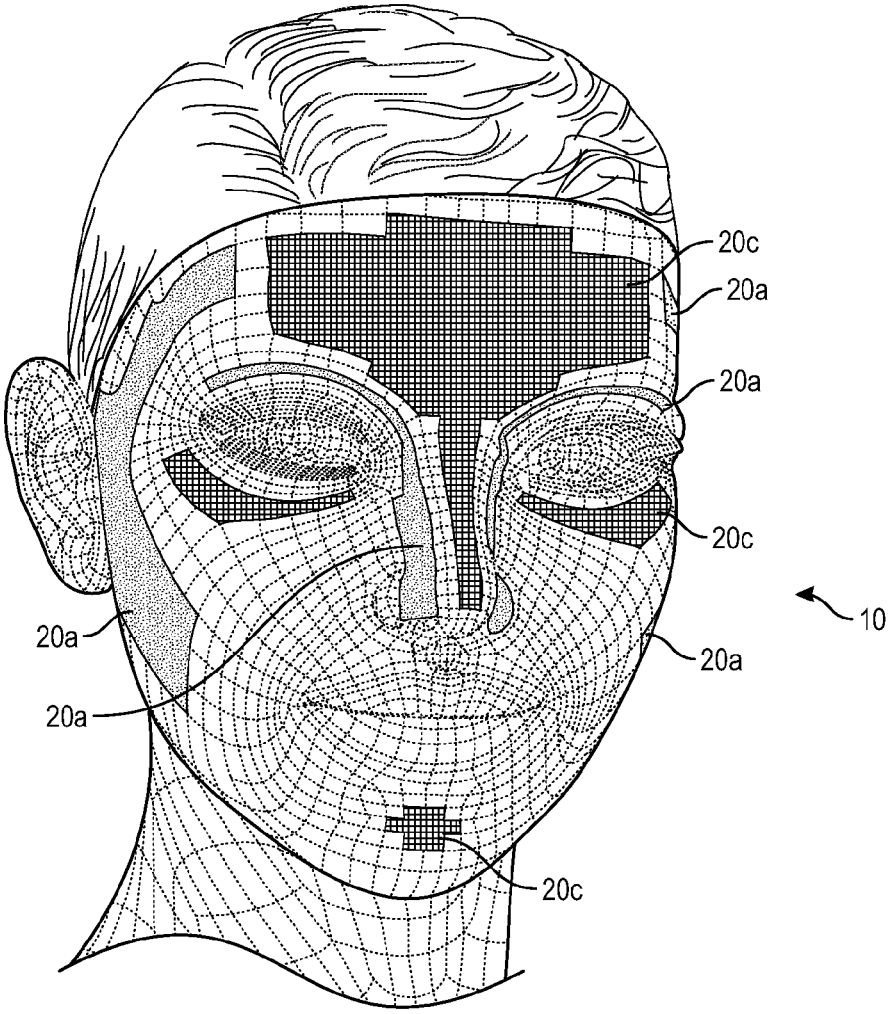
FIG. 8 is a facial map illustrating example contour and highlighting mapped to the face by the makeup applicator of FIG. 1.
Figure 9:
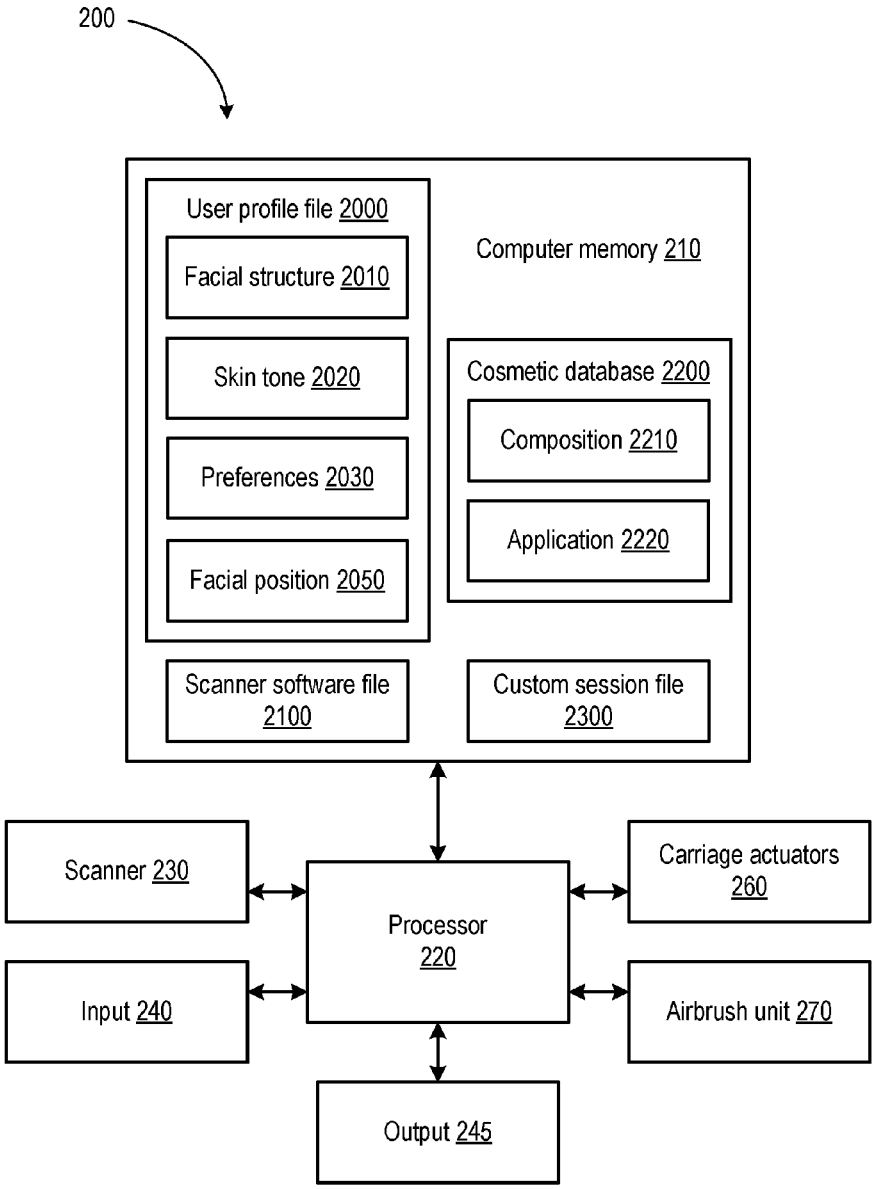
FIG. 9 is a block diagram illustrating aspects of a makeup applicator according to another embodiment of the current invention.

Attention is now directed to FIG. 7, where step S140 is further illustrated. As an example, the facial-structure information 1010 indicates that the face 10 has an oval facial structure and a particular contour of the eyes, nose, cheeks, jaw, chin, and skin; the skin-tone information 1020 indicates a warm skin tone; and the user preference file 1030 indicates that highlighting and contouring is desired in a particular palette, and that particular contouring makeup 20 is available for selection or already in the cosmetic reservoir 180. At step S141, the processor 120 accesses the skin-tone information 1020, the user preference file 1030, and the makeup color information 1210, and look-up tables or logic causes the processor 120 to either confirm that the available shade of contour (makeup 20) is appropriate or suggest an available shade based on the warm skin tone, the desired palette, and the makeup properties. At step S142, the processor 120 accesses the facial-structure information 1010 and the baseline makeup application information 1220, and look-up tables or logic causes the processor 120 to determine that the contour (makeup 20) should be applied to certain facial areas based on the oval face shape and the contour of the eyes, nose, cheeks, jaw, chin, and skin. At step S143, the processor maps the facial areas determined in step S142 onto the specific facial structure of the face 10; an example mapping is illustrated in FIG. 8, showing contour makeup 20*a* and highlighting makeup 20*c* mapped to the face 10. In some embodiments, a virtual reality output (e.g., through a projector output 145 projecting an image of the mapped makeup 20 on the user's face 10, or through a display screen output 145 showing an image of the user's face 10 with the mapped makeup 20) may be used to allow the user to verify (through the input 140) the proposed makeup application. And at step S144, the processor creates an instruction file for controlling the carriage actuators 160 and the valves 175, 195 to achieve the specific layout of the makeup 20 mapped onto the face 10 in step S143. The instruction file created in step S144 may be keyed to a particular facial position. Thus, as the facial-position information 1050 indicates that the facial position has changed, the processor 120 may adjust the actual operation of the carriage actuators 160 and the valves 175, 195 accordingly in steps S160, S170.

FIGS. 9 through 12 illustrate another makeup applicator 200 that is substantially similar to the embodiment 100, except as specifically noted and/or shown, or as would be inherent. Further, those skilled in the art will appreciate that the embodiment 100 (and thus the embodiment 200) may be modified in various ways, such as through incorporating all or part of any of the various described embodiments, for example. For uniformity and brevity, reference numbers from 200 to 299 may be used to indicate elements corresponding to those discussed above numbered from 100 to 199 (e.g., computer memory 210 corresponds generally to the computer memory 110, processor 220 corresponds generally to the processor 120, scanner 230 corresponds generally to the scanner 130, output 245 corresponds generally to the output 145, carriage actuators 260 correspond generally to the carriage actuators 160, et cetera), though with any noted, shown, or inherent deviations. And reference numbers 2000 to 2999 may be used to indicate elements corresponding to those discussed above numbered from 1000 to 1999 (e.g., user profile file 2000 corresponds generally to the user profile file 1000, facial-structure information 2010 corresponds generally to the facial-structure information 1010, skin-tone information 2020 corresponds generally to the skin-tone information 1020, user preference file 2030 corresponds generally to the user preference file 1030, facial-position information 2050 corresponds generally to the facial-position information 1050, scanner software file 2100 corresponds generally to the scanner software file 1100, the cosmetic database 2200 corresponds generally to the cosmetic database 1200, makeup composition information 2210 corresponds generally to the makeup composition information 1210, baseline makeup application information 2220 corresponds generally to the baseline makeup application information 1220, custom session file 2300 corresponds generally to the custom session file 1300), though with any noted, shown, or inherent deviations.

Figure 10:
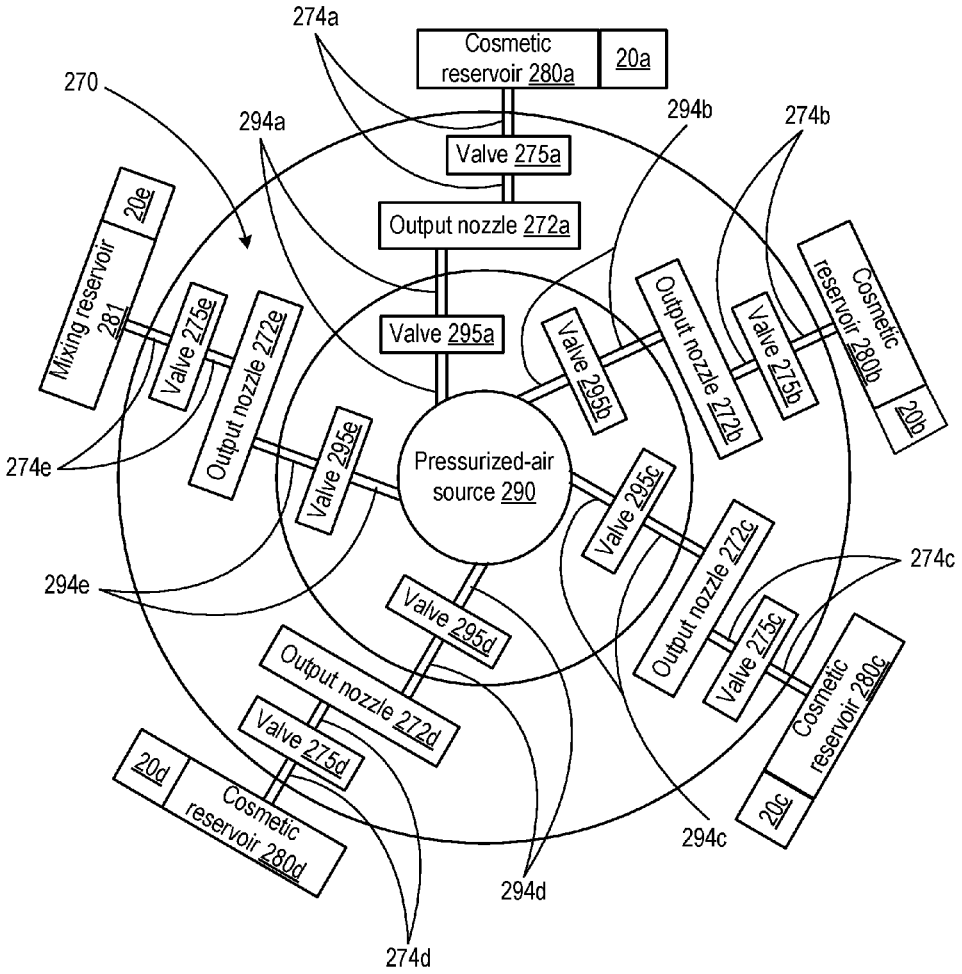
FIG. 10 is a block diagram illustrating other aspects of the makeup applicator of FIG. 9.

In embodiment 200, the cosmetic unit 270 accesses multiple cosmetic reservoirs 280 (e.g., 280*a*, 280*b*, 280*c*, 280*d*), with each containing a different makeup 20 (e.g., a first contour makeup may be in the reservoir 280*a*, a second contour makeup may be in the reservoir 280*b*, a first highlighting makeup may be in the reservoir 280*c*, and a second highlighting makeup may be in the reservoir 280*d*). The cosmetic unit 270 may additionally access a mixing reservoir 281, which is described further below. In the embodiment 200, cosmetic airbrush 271 has multiple output nozzles 272. FIG. 10 shows that an output nozzle 272 may be associated with each reservoir 280, 281 (e.g., through a respective supply passage 274 and valve 275 in data communication with the processor 220). While FIG. 10 shows a single pressurized-air source 290 connected through tubing 294*a*, 294*b*, 294*c*, 294*d*, 294*e*, multiple pressurized-air sources 290 may instead be used.

Figure 11:
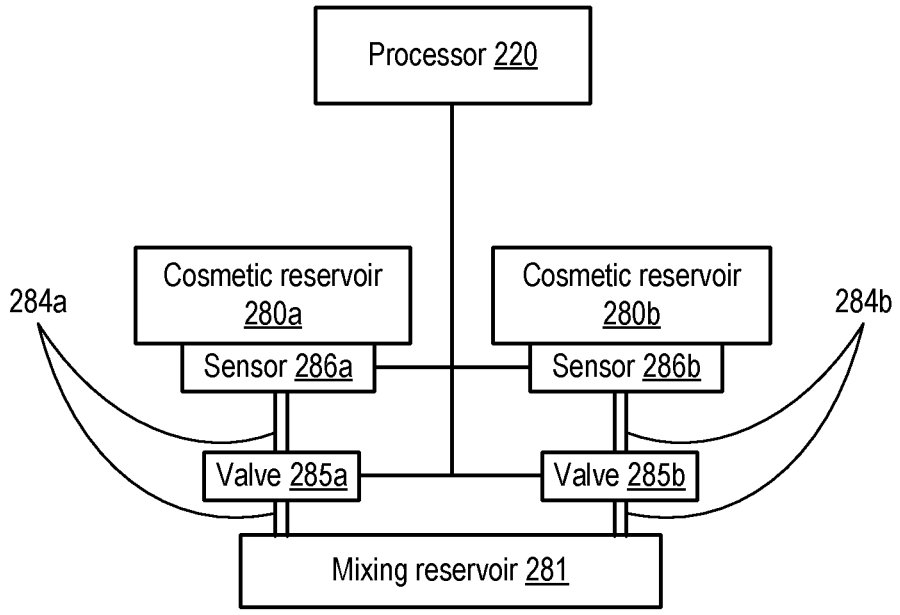
FIG. 11 is a block diagram illustrating still other aspects of the makeup applicator of FIG. 9.
Figure 12:
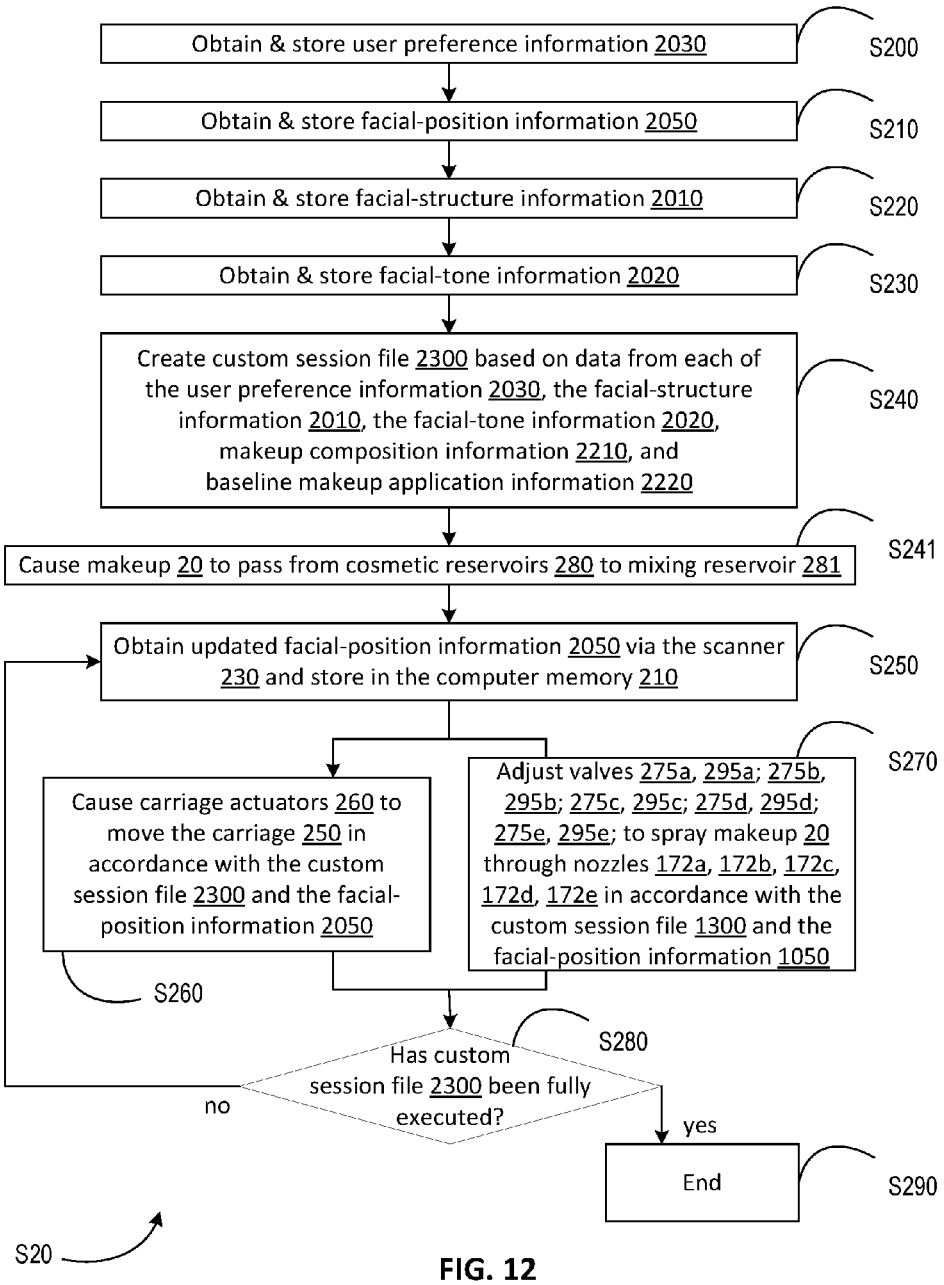
FIG. 12 is a flowchart illustrating various steps performed by the makeup applicator of FIG. 9.

The mixing reservoir 281 may be initially empty of makeup 20, but may be in communication with multiple cosmetic reservoirs 280 (e.g., through passages 284 and valves 285 as shown in FIG. 11). In some embodiments, the mixing reservoir 281 is below the cosmetic reservoirs 280 to allow makeup 20 to be gravity fed from the cosmetic reservoirs 280 into the mixing reservoir 281 when permitted by the valves 285. The valves 285 are in data communication with the processor 220, and sensors 286 (e.g., flow sensors, weight sensors, et cetera) may further be in communication with the processor 220 for determining how much makeup 20 passes from the cosmetic reservoirs 280 to the mixing reservoir 281.

Use of the makeup applicator 200 differs from use of the makeup applicator 100 in two main ways. First, the makeup applicator 200 may create custom makeup 20 by mixing together different makeup 20 in the mixing reservoir 281. Second, the makeup applicator 200 has multiple output nozzles 272 and may spray multiple types of makeup 20, sometimes simultaneously. Process S20 in FIG. 12 corresponds generally to the process S10 discussed above and shown in FIG. 6, and for uniformity and brevity, reference numbers from S200 to S299 may be used to indicate steps corresponding to those discussed above numbered from S100 to S199 (e.g., steps S100, S110, S120, S130, S140, S150, S160, S170, S180, S190 correspond generally to steps S200, S210, S220, S230, S240, S250, S260, S270, S280, S290), though with any noted, shown, or inherent deviations. Especially with multiple types of makeup 20 being used in the makeup applicator 200, it may be important to correctly, quickly, and easily identify the types of makeup 20 available and the specific locations of the makeup 20 (i.e., which makeup 20 is in which cosmetic reservoir 280). To this end, it may be particularly useful for the different types of makeup 20 to be associated with unique identifiers (e.g., bar codes), and for the input 240 to include one or more sensors (e.g., bar code scanners). Thus, the user preference information 2030 obtained at step S200 may include makeup identity and location information for at least two types of makeup 20, obtained by the processor 220 via a sensor of the input 240.

In the process S20, at step S240, the processor 220 further creates mixing information in the custom session file 2300 based on the user preference information 2030 and the makeup composition information 2210. At step S241, the processor 220 causes the valves 285*a*, 285*b* to pass makeup 20*a*, 20*b* from the cosmetic reservoirs 280*a*, 280*b* to the mixing reservoir 281 to create makeup 20*e*, based on the custom session file 2300 created at step S240 and data from the sensors 286*a*, 286*b*. And at step S270, to apply makeup 20 to the face 10, the processor 220 causes the valves 275*a*, 295*a* to selectively allow makeup 20*a* to flow through the supply passage 274*a* and the output nozzle 272*a*, the valves 275*b*, 295*b* to selectively allow makeup 20*b* to flow through the supply passage 274*b* and the output nozzle 272*b*, the valves 275*c*, 295*c* to selectively allow makeup 20*c* to flow through the supply passage 274*c* and the output nozzle 272*c*, the valves 275*d*, 295*d* to selectively allow makeup 20*d* to flow through the supply passage 274*d* and the output nozzle 272*d*, and the valves 275*e*, 295*e* to selectively allow makeup 20*e* to flow through the supply passage 274*e* and the output nozzle 272*e*, all in accordance with the custom session file 2300 and the facial-position information 2050. For a period of time, the processor 220 may cause makeup 20 to be sprayed through multiple nozzles 272 simultaneously.

Figure 14:
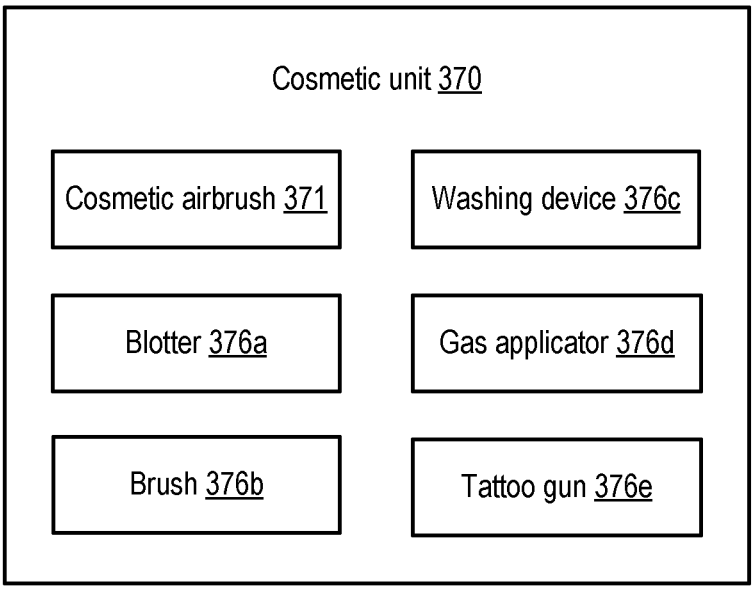
FIG. 14 illustrates an alternate cosmetic unit that may be used in embodiments of the current invention.

FIG. 14 illustrates another cosmetic unit 370 that may be used in embodiments of the current invention. For uniformity and brevity, reference numbers from 300 to 399 may be used to indicate elements corresponding to those discussed above numbered from 200 to 299 (e.g., cosmetic airbrush 371 corresponds generally to the cosmetic airbrush 271). The cosmetic unit 370 differs from the cosmetic unit 270 in two main ways: the cosmetic unit 370 has a blotter 376*a*, a brush 376*b*, a washing device 376*c* (e.g., washing cloth or pad, cleanser sprayer, et cetera), a gas applicator 376*d* (e.g., gas or aerosol sprayer, et cetera), and a tattoo gun 376*e*. In embodiments having the blotter 376*a*, the brush 376*b*, the washing device 376*c*, the gas applicator 376*d*, and/or the tattoo gun 376*e*, part of the custom session file 1300/2300 may include instructions for how to move and actuate those elements.

Some embodiments may further include an ionizing device to provide a negative charge to the user (and thus the face 10), and utilize a cosmetic product 20 having a positive charge. This may result in improved absorption of the cosmetic product 20. The ionizing device may include a mat that the user sits upon or rests her feet upon, a handle that the user holds, et cetera.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. The specific configurations and contours set forth in the accompanying drawings are illustrative and not limiting. Some steps may be performed in different orders than described herein.

The invention claimed is:

1. A system for automatically applying makeup to a human face located in an application zone, comprising:

a first cosmetic reservoir housing first makeup;

a second cosmetic reservoir housing second makeup;

a mixing reservoir in communication with the first and second reservoirs; the mixing reservoir selectively receiving the first makeup and the second makeup from the first and second reservoirs, thereby creating a third makeup;

a non-transitory computer memory;

a processor in data communication with the computer memory;

a scanning device positioned to obtain facial-structure information, facial-position information, and facial-tone information from the application zone; the scanning device being in data communication with the processor;

a carriage;

carriage actuators for moving the carriage laterally and transversely adjacent the application zone, the carriage actuators being in data communication with the processor;

a cosmetic airbrush unit coupled to and movable with the carriage; the cosmetic airbrush unit comprising a first output nozzle, a first supply passage for supplying the first makeup from the first reservoir to the first output nozzle, a first valve selectively allowing the first makeup to flow through the first supply passage and the first output nozzle, a second output nozzle, a second supply passage for supplying the second makeup from the second reservoir to the second output nozzle, a second valve selectively allowing the second makeup to flow through the second supply passage and the second output nozzle, a third output nozzle, a third supply passage for supplying the third makeup from the mixing reservoir to the third output nozzle, a third valve selectively allowing the third makeup to flow through the third supply passage and the third output nozzle; the first valve being in data communication with the processor; the second valve being in data communication with the processor; the third valve being in data communication with the processor;

programming causing the scanning device to obtain the facial-structure information, the facial-position information, and the facial-tone information;

programming causing the computer memory to store the obtained facial-structure information, the obtained facial-position information, and the obtained facial-tone information;

programming causing the carriage actuators to selectively move the carriage;

programming causing the first valve to selectively allow the first makeup to flow through the first supply passage and the first output nozzle, thereby applying the first makeup to the human face;

programming causing the second valve to selectively allow the second makeup to flow through the second supply passage and the second output nozzle, thereby applying the second makeup to the human face; and programming causing the third valve to selectively allow the third makeup to flow through the third supply passage and the third output nozzle, thereby applying the third makeup to the human face.

2. The system of claim 1, further comprising at least one item selected from the group consisting of an air tank and a compressor, the at least one item providing pressurized air to the cosmetic airbrush unit.

3. The system of claim 1, further comprising:

programming causing the scanning device to repeatedly obtain updated facial-position information; and programming causing the computer memory to store the updated facial-position information.

4. The system of claim 3, further comprising:

a user preference file accessible by the processor;

a cosmetic database accessible by the processor, the cosmetic database having baseline makeup application information;

programming causing the processor to create a custom session file based on data from each of:

(a) the obtained facial-structure information;

(b) the obtained facial-tone information;

(c) the user preference file; and (d) the baseline makeup application information;

wherein the programming causing the carriage actuators to selectively move the carriage, the programming causing the first valve to selectively allow the first makeup to flow through the first supply passage and the first output nozzle, and the programming causing the second valve to selectively allow the second makeup to flow through the second supply passage and the second output nozzle utilize the custom session file and the updated facial-position information.

5. The system of claim 1, further comprising at least one sensor for determining the identity of the first makeup and the identity of the second makeup.

6. The system of claim 5, wherein the at least one sensor is a barcode reader.

7. The system of claim 1, wherein, for a period of time, the programming causing the second valve to selectively allow the second makeup to flow through the second supply passage and the second output nozzle causes the second makeup to flow through the second output nozzle simultaneously with the first makeup flowing through the first output nozzle.

* * * * *